US011959411B1

(12) United States Patent
Mehmood et al.

(10) Patent No.: US 11,959,411 B1
(45) Date of Patent: Apr. 16, 2024

(54) TREATMENT SYSTEM FOR GASOLINE COMPRESSION IGNITION ENGINE EXHAUST

(71) Applicant: SAUDI ARABIAN OIL COMPANY, Dhahran (SA)

(72) Inventors: Fakhar Mehmood, Dhahran (SA); Maryam M. Al-Taher, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/066,734

(22) Filed: Dec. 15, 2022

(51) Int. Cl.
*F01N 3/20* (2006.01)
*F01N 3/10* (2006.01)
(Continued)

(52) U.S. Cl.
CPC ..... *F01N 3/208* (2013.01); *F01N 3/10* (2013.01); *F01N 3/28* (2013.01); *F01N 13/009* (2014.06); *F01N 2250/12* (2013.01); *F01N 2340/02* (2013.01); *F01N 2370/00* (2013.01); *F01N 2560/021* (2013.01); *F01N 2570/10* (2013.01); *F01N 2570/12* (2013.01); *F01N 2570/14* (2013.01); *F01N 2570/18* (2013.01)

(58) Field of Classification Search
CPC ... F01N 3/208; F01N 3/10; F01N 3/28; F01N 13/009; F01N 2250/12; F01N 2340/02; F01N 2370/00; F01N 2560/021; F01N 2570/10; F01N 2570/12; F01N 2570/14; F01N 2570/18
See application file for complete search history.

(56) References Cited

U.S. PATENT DOCUMENTS 10,738,671 B2 8/2020 Gupta et al.
2011/0000194 A1* 1/2011 Gonze ..... F01N 3/103 60/297

(Continued)

OTHER PUBLICATIONS

Presentation: 40th International Vienna Motor Symposium, AECC, May 16, 2019, 22 pages.

(Continued)

*Primary Examiner* — Brandon D Lee
(74) *Attorney, Agent, or Firm* — Osha Bergman Watanabe & Burton LLP

(57) ABSTRACT

A system for treatment of gasoline compression ignition engine exhaust includes components of a carbon monoxide absorber and a nitrogen oxide absorber, wherein nitrogen oxide comprises one or more compounds consisting of nitrogen and oxygen; an oxidation catalyst downstream of the carbon monoxide absorber; a close coupled reduction catalyst downstream of the nitrogen oxide absorber; an underfloor reduction catalyst downstream of the close coupled reduction catalyst; and an ammonia slip catalyst downstream of the underfloor reduction catalyst. A method for making the system includes aligning the components into the system; configuring the carbon monoxide absorber to capture and store carbon monoxide under cold start operation; configuring the nitrogen oxide absorber to capture and store nitrogen oxide, under cold start operation; and configuring the underfloor reduction catalyst and ammonia slip catalyst to in combination reduce slip ammonia released by the close coupled reduction catalyst under high load operation.

16 Claims, 2 Drawing Sheets

(51) Int. Cl.
*F01N 3/28* (2006.01)
*F01N 13/00* (2010.01)

(56) References Cited

U.S. PATENT DOCUMENTS

| | | | | |
|---|---|---|---|---|
| 2015/0275730 | A1* | 10/2015 | Gupta | B01D 53/9486 60/276 |
| 2017/0276053 | A1* | 9/2017 | Robel | F01N 13/0093 |
| 2019/0299161 | A1* | 10/2019 | Collier | B01J 37/0201 |
| 2020/0370454 | A1* | 11/2020 | Gupta | F01N 13/0093 |
| 2021/0207511 | A1* | 7/2021 | Hamad | F01N 3/103 |

OTHER PUBLICATIONS

Bello et al., "Deactivation and regeneration studies on Pd-containing medium pore zeolitesas passive NOx adsorbers (PNAs) in cold-start applications," Microporous and Mesoporous Materials, 2020, 39 pages.

Bielaczyc et al., "Trends in Automotive Emission Legislation: Impact on LD Engine Development, Fuels, Lubricants and Test Methods: a Global View, with a Focus on WLTP and RDE Regulations". Emission Control Science and Technology, 2019, 13 pages.

Bielaczyc et al., "Symposium Proceedings—Trends in automotive emissions legislation: Impact on LD Engine development, fuels lubricants and testmethods: a global view with focus on the WLTP and RDE regulations—Summary of the 6th International Exhaust Emmisions Symposium (IEES)," Combustion Engines, 2018, 10 pages.

Boger et al., "Developments for future EU7 regulations and the path to zero impact emissions—A catalyst substrate and filter supplier's perspective," Transportation Engineering, 2022, 10 pages.

Demuynck et al., "Integrated Diesel System Achieving Ultra-Low Urban and Motorway NOx Emissions on the Road," AECC, 2019, 20 pages.

"Monitoring by Control Technique—Activated Carbon Adsorber," Dec. 16, 2021, Retrieved from the Internet: URL: <https://www.epa.gov/air-emissions-monitoring-knowledge-base/monitoring-control-technique-activated-carbon-adsorber>, 6 pages.

Moliner et al., "Synthesis Strategies for Preparing Useful Small Pore Zeolites and Zeotypes for Gas Separations and Catalysis," Chemistry of Materials, 2014, 13 pages.

Sampara et al., "Hydrocarbon storage modeling for diesel oxidation catalysts," Chemical Engineering Science, vol. 63, Issue 21, 2008, 14 pages.

* cited by examiner

TREATMENT SYSTEM FOR GASOLINE COMPRESSION IGNITION ENGINE EXHAUST

BACKGROUND

Conventional systems for treatment of light duty gasoline compression ignition engine exhaust have the disadvantage insufficiently effective operation to treat the exhaust to reduce carbon monoxide and nitrogen oxide in the exhaust in the conditions of both cold start and high load. Such treatment systems are typically called aftertreatment systems. Cold start conditions apply when starting the engine. At cold start the exhaust is cold. High load conditions occur during motorway operation and apply when the force that acts against the power an engine produces is high. This can occur at high speed and/or on climbing an incline. At high load there is very high exhaust flow and temperature.

Conventional systems include an oxidation catalyst and a reduction catalyst, which cause the ineffective operation in cold start and high load conditions. The oxidation catalyst oxidizes carbon monoxide and hydrocarbons in the exhaust into carbon dioxide and water. The reduction catalyst reduces nitrogen oxide in the exhaust into nitrogen and water. Nitrogen oxide indicates one or more compounds that are made up of nitrogen and oxygen. Examples are nitric oxide and nitrogen dioxide. In the cold start cycles, oxidation catalysts and reduction catalysts don't work in temperatures. In high load conditions, the nitrogen oxide reduction is not effective, and causes a significant amount of $NH_3$ slip.

Conventional systems meet current regulatory requirements, for example EU6 European requirements. However, these systems are not expected to meet EU7 requirements to be introduced, expected in about 2025 Or 2026. Thus, current aftertreatment (A/T) systems are not sufficiently effective at cold start and in high load.

Accordingly, there exists a need for a treatment system for gasoline compression ignition engine exhaust with improved efficiency in cold start and high load conditions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for treatment of gasoline compression ignition engine exhaust including a carbon monoxide absorber and a nitrogen oxide absorber, wherein nitrogen oxide comprises one or more compounds consisting of nitrogen and oxygen; an oxidation catalyst downstream of the carbon monoxide absorber; a close coupled reduction catalyst downstream of the nitrogen oxide absorber; an underfloor reduction catalyst downstream of the close coupled reduction catalyst; and an ammonia slip catalyst downstream of the underfloor reduction catalyst.

In another aspect, embodiments disclosed here in relate to a method of making a system for treating gasoline compression ignition engine exhaust including: aligning into the system a plurality of components including a carbon monoxide absorber and a nitrogen oxide absorber, wherein nitrogen oxide comprises one or more compounds consisting of nitrogen and oxygen; an oxidation catalyst downstream of the carbon monoxide absorber; a close coupled reduction catalyst downstream of the nitrogen oxide absorber; an underfloor reduction catalyst downstream of the close coupled reduction catalyst; and an ammonia slip catalyst downstream of the underfloor reduction catalyst; configuring the carbon monoxide absorber to capture and store carbon monoxide under cold start operation; configuring the nitrogen oxide absorber to capture and store nitrogen oxide, under cold start operation; and configuring the underfloor reduction catalyst and ammonia slip catalyst to in combination reduce slip ammonia released by the close coupled reduction catalyst under high load operation.

Other aspects and advantages of the claimed subject matter will be apparent from the following description and the appended claims.

DETAILED DESCRIPTION

Figure 1:
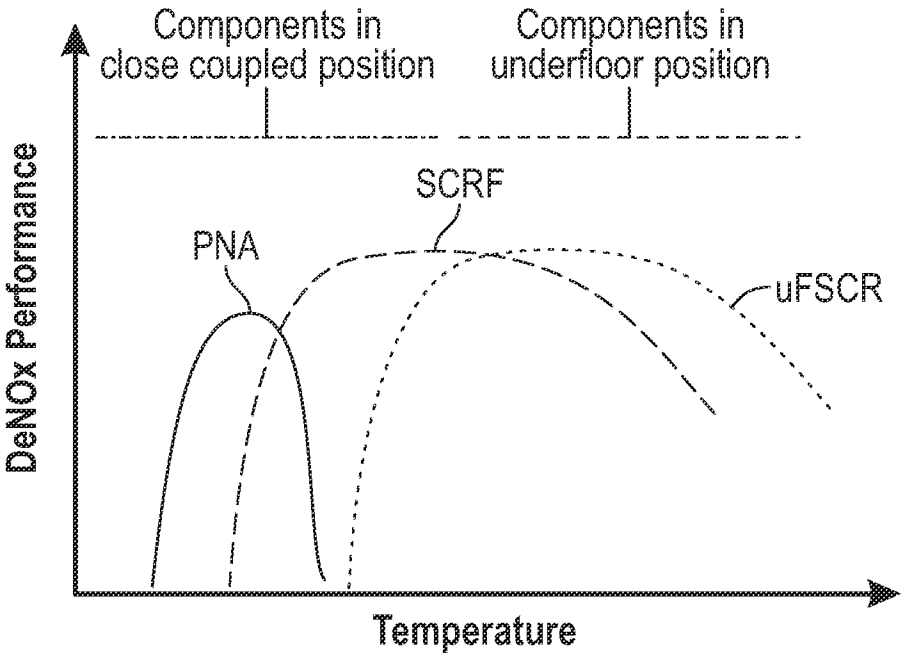
FIG. 1 is a schematic visualization of deNOx performance variation with temperature, in accordance with to one or more embodiments.

The present system and method provide efficient treatment of gasoline compression ignition engine exhaust in cold start and high load conditions. The present system and method are effective in cold start and high load conditions. The present system and method provide three functions of catalysis convert and capture in one system for efficient emission reduction in cold start and high load conditions. In cold start, providing carbon monoxide and nitrogen oxide absorbers and optional an electrically heated catalyst increase the operational window to cold exhaust at cold start. At high load, a combination of underfloor reduction catalyst unit and ammonia slip catalyst with in between ammonia sensor giving feedback for slip compensates for ineffective close coupled reduction catalyst is not effective at very high exhaust flow and temperature. The present system and method extends the operating window of exhaust aftertreatment to reduce the overall emissions to near-zero levels in all operating conditions.

The description herein uses the following terminology.

The term "SCRF" denotes a particulate filter with an "SCR" catalyst coating to treat NOx. The SCRF may also treat particulates and at the same time.

The term "SCR" denotes a selective catalytic reduction, which converts nitrogen oxides with the aid of a catalyst into $N_2$. Water, a gaseous reductant, typically urea, is added to a stream of flue or exhaust gas and is adsorbed onto a catalyst. By extension, this also refers to the selective catalytic reduction catalyst itself.

The term "NOx" denotes nitrogen oxides, such as nitric oxide, NO, and nitrogen dioxide, $NO_2$. NOx is a regulated pollutant critical for current and future emission legislation compliance.

The term "PNA" denotes passive NOx absorber.

The term "uFSCR" denotes underfloor selective catalytic reduction. By extension, this also refers to the underfloor selective catalytic reduction catalyst itself.

The term "HC" denotes hydrocarbon. The hydrocarbons (HCs) may be non-burnt hydrocarbons. The HCs can be of different chemical composition (e.g., methane hexane, decane, etc.)

The term "CO" denotes carbon monoxide. CO is main component used in the "LNT" for the reduction phases (high levels targeted), generated in the combustion chamber where the fuel is in excess locally. LNT denotes lean NOx trap.

The term "NH3" denotes ammonia, $NH_3$.

The term "PM" denotes particulate matter.

The term "CO2" indicates carbon dioxide, $CO_2$. $CO_2$ is typically directly related to fuel consumption. It is desirable for $CO_2$ to be pushed as low as possible, impacted by the amount and duration of the rich purges, which may involve additional fuel injections.

The term "eHC" denotes Electrically Heated Catalyst.

The term "P(elec)" denotes electric power.

In one aspect, embodiments disclosed herein relate to a system for treatment of gasoline engine exhaust that includes a carbon monoxide absorber and a nitrogen oxide absorber, where nitrogen oxide includes one or more compounds consisting of nitrogen and oxygen; an oxidation catalyst downstream of the carbon monoxide absorber; a close coupled reduction catalyst downstream of the nitrogen oxide absorber; an underfloor reduction catalyst downstream of the close coupled reduction catalyst; and an ammonia slip catalyst downstream of the underfloor reduction catalyst.

In one or more embodiments, the present system includes an oxidation catalyst for carbon monoxide removal, and a selective catalytic reduction catalyst for nitrogen oxide reduction. The oxidation catalyst may also remove hydrocarbons. The oxidation catalyst may include different absorbing materials, where at least one of the absorbing material is adapted for carbon monoxide absorption and at least one of the absorbing material is adapted for hydrocarbon absorption. Suitable oxidation catalysts include transition metal oxide catalyst such as titanium dioxide catalyst. Suitable commercially available oxidation catalysts include Johnson Matthey's oxidation catalyst. It will be understood that the oxidation catalyst is a suitable oxidation catalyst for exhaust from a gasoline compression engine. Suitable selective catalytic reduction catalysts include Oxides of vanadium, molybdenum, tungsten, and zeolites. Suitable commercially available catalytic reduction catalysts include Johnson Matthey's SINOx honeycomb selective catalyst reduction catalyst. It will be understood that the selective catalyst reduction catalyst is a suitable catalytic reduction catalyst for exhaust from a gasoline compression ignition engine. The selective catalytic reduction catalyst is coated on a particular filter. Suitable particle filters are made of materials including silicon carbine material that is formed in a honeycomb structure and have a pore size of about 10 to about 13 microns. The total volume of the honeycomb structure is about 2 to about 4 liters for a particulate filter in a typical passenger car.

The oxidation and reduction catalysts may have limitations for operating temperature window for effective emission removal. For example, these catalysts may be only effective above about 200° C. So, in a cold start cycle the emissions are not reduced until the exhaust reaches this temperature range. In addition, in high load motorway cycles, at very high exhaust flow and temperature (above about 400° C.) the SCR may be not effective, and also causes a significant amount of NH3 slip. Thus, herein cold start may indicate an exhaust temperature up to about 200° C. Further, herein high load may indicate an exhaust temperature above about 400° C. Standard operation and similarly standard conditions may indicate a temperature from about 200° C. to about 400° C.

FIG. 1 shows as schematic visualization of a combination of PNA and uFSCR technologies to enable optimal NOx performance. FIG. 1 illustrates that the combination of different components positioned along the exhaust line provides increase system deNOx performance across a wide variety of driving conditions. FIG. 1 illustrates the present system and method when the nitrogen oxide absorber is a passive nitrogen oxide absorber (PNA), the reduction catalyst is a particulate filter with a selective catalytic reduction catalyst coating (SCRF), and the underfloor reduction catalyst is an underfloor selective catalytic reduction catalyst (uFSCR).

In one or more embodiments, the system further includes an electrically heated catalyst between the oxidation catalyst and the close coupled reduction catalyst.

In one or more embodiments, the system further includes an ammonia sensor between the underfloor reduction catalyst and the ammonia slip catalyst, wherein the ammonia sensor is coupled to one or more reaction conditions of the underfloor reduction catalyst. The ammonia sensor may also sense nitrogen oxide. A suitable commercially available ammonia sensor is the Delphi ammonia sensor. It will be understood that the system may include an aftertreatment controller which has function for one or more of ammonia control and input into NOx control. It will be understood that ammonia operation and control may be independent of operation and control of the PNA and the absorbing materials for carbon monoxide and hydrocarbons.

Figure 2:
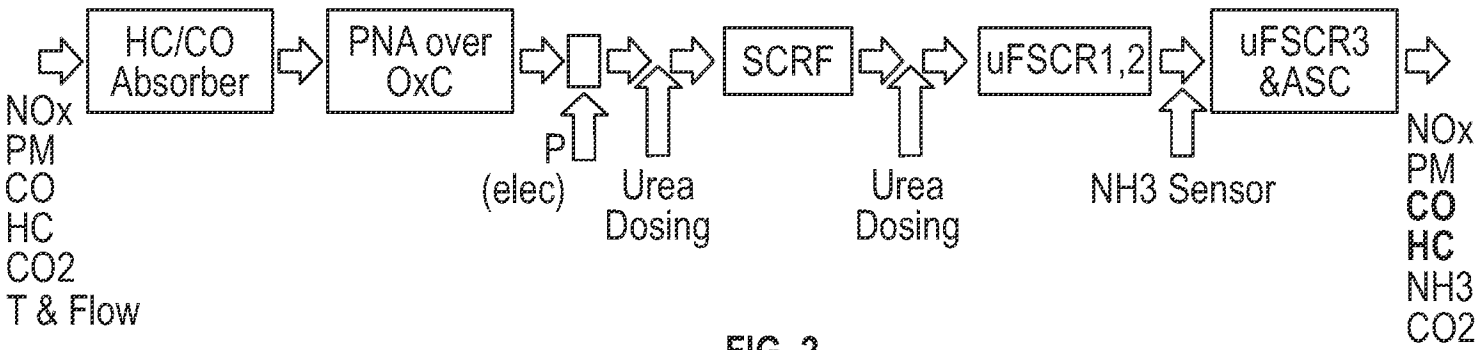
FIG. 2 is a schematic diagram of an aftertreatment system, in accordance with one or more embodiments.

FIG. 2 shows a system incorporating a combination of PNA and uFSCR technologies. A NOx trap PNA (Passive NOx Absorber) in close-coupled is added in addition to the reduction catalyst to optimize the NOx reduction (deNOx) performance over all operating conditions. In addition, HC and CO absorber (sorbents) are add to the oxidation catalyst to capture the cold start high spikes of Hydrocarbons and CO emissions. These absorbers (sorbents) work best at lower temperatures. They capture and store emissions at lower exhaust temperatures and then release the at higher temperatures typically at and above a release temperature of from about 200° C. to about 250° C., for example about 200° C. By that time, the downstream aftertreatment systems reach their operating conditions. Furthermore, for active heating measure, electrically heated catalyst is added. In addition, for high exhaust flow and temperature problem, a combination of underfloor SCR units and ASC with in-between NOx/NH3 sensor, giving feedback for slip, is added.

FIG. 2 illustrates the present system and method when the carbon monoxide absorber also absorbs hydrocarbons (CH/CO absorber), the nitrogen absorber is a PNA disposed over an oxidation catalyst (OxC), the system includes an electrically heated catalyst receiving electric power (P(elec)), the reduction catalyst is a is a particulate filter with a selective catalytic reduction catalyst coating (SCRF), which receives urea dosing of urea as a reducing agent, the underfloor reduction catalyst is an underfloor selective catalytic reduction catalyst (uFSCR), which receives urea dosing of urea as a reducing agent, and the system further includes an ammonia ($NH_3$) sensor between the underfloor reduction catalyst and the ammonia slip catalyst (ASC), wherein the ammonia sensor is coupled to one or more reaction conditions of the ammonia slip catalyst.

In one or more embodiments, the carbon monoxide absorber includes or is a passive carbon monoxide absorber. In one or more embodiments, the carbon monoxide absorber includes or is a material that absorbs carbon monoxide and one or more hydrocarbons. In one or more embodiments, the carbon monoxide absorber includes or is a carbon monoxide absorbing material includes or is activated carbon.

In one or more embodiments, the nitrogen oxide absorber is disposed over the oxidation catalyst. The nitrogen oxide absorber and the oxidation catalysts may both be coated on the same monoliths. Such dually coated monoliths are commercially available. For example, Johnson Mathey and BASF provide lean NOx traps ("LNT"). Alternatively, the nitrogen oxide absorber and the oxidation catalyst may be coated on separate monoliths. In one or more embodiments, the nitrogen oxide absorber is incorporated with the oxidation catalyst. In one or more embodiments, the nitrogen oxide absorber includes or is a passive nitrogen oxide absorber. In one or more embodiments, the nitrogen oxide absorber includes or is a Pd-containing medium pore zeolite.

In another aspect, embodiments disclosed herein relate to a method of making a system for treating gasoline engine exhaust that includes aligning into the system a plurality of components that include a carbon monoxide absorber and a nitrogen oxide absorber, wherein nitrogen oxide includes one or more compounds consisting of nitrogen and oxygen; an oxidation catalyst downstream of the carbon monoxide absorber; a close coupled reduction catalyst downstream of the nitrogen oxide absorber; an underfloor reduction catalyst downstream of the close coupled reduction catalyst; and an ammonia slip catalyst downstream of the underfloor reduction catalyst. The method further includes configuring the carbon monoxide absorber to capture and store carbon monoxide under cold start operation; configuring the nitrogen oxide absorber to capture and store nitrogen oxide, under cold start operation; and configuring the underfloor reduction catalyst and ammonia slip catalyst to in combination reduce slip ammonia released by the close coupled reduction catalyst under high load motorway operation.

In one or more embodiments, aligning the plurality of components further includes disposing an electrically heated catalyst between the oxidation catalyst and the close coupled reduction catalyst.

In one or more embodiments, configuring the underfloor reduction catalyst and ammonia slip catalyst includes disposing an ammonia sensor therebetween, and coupling the ammonia sensor to one or more reaction conditions of the ammonia slip catalyst. The ammonia sensor may also sense nitrogen oxide.

Referring to FIG. 2, in cold start operation, The PNA (Passive NOx Absorber) and HC/CO Absorber (sorbents) actively capture and store pollutants mainly during low-speed, city driving conditions. The capacity (and sizing) of these absorbers is being optimised such that they can store all the engine-out HC, CO and NOx from cold-start until the other aftertreatment systems ("OxC" and SCR) reach their optimal operating conditions. OxC indicates an oxidation catalyst, such as a catalyst used on internal combustion engine ("ICE") vehicles, treating HC and CO after light off. A low thermal mass SCR is added in close-coupled position for an optimum SCR light-off performance. This close-coupled SCR consists of an SCR catalyst coated on a Particulate Filter (SCRF). This enables optimal synergy between PNA and SCR deNOx performance during city driving at low exhaust temperatures, as visualized at the left side of FIG. 1.

Still referring to FIG. 2, In high load operation, at very high exhaust flow and temperature the SCRF is no more effective, and also causes a significant amount of $NH_3$ slip. This has been solved here with a combination of underfloor SCR units (uFSCR) and ASC with in-between NOx/$NH_3$ sensor giving feedback for slip. These downstream catalysts experience lower temperatures compared to the close-coupled SCR system enabling them to be effective at higher vehicle speed/loads. Combined with a $2^{nd}$ AdBlue (Urea) dosing unit, they improve deNOx performance at motorway conditions (high speed and load). This is visualized at the right side of FIG. 1.

In one or more embodiments, configuring the carbon monoxide absorber includes selecting the carbon monoxide absorber to include a passive carbon monoxide absorber. In one or more embodiments, configuring the carbon monoxide absorber includes selecting the carbon monoxide absorber to include a material that absorbs carbon monoxide and one or more hydrocarbons. In one or more embodiments, configuring the carbon monoxide absorber includes selecting the carbon monoxide absorber to include a carbon monoxide absorbing material selected includes or is activated carbon.

In one or more embodiments, configuring the nitrogen oxide absorber includes disposing the nitrogen oxide absorber over the oxidation catalyst. In one or more embodiments, configuring the nitrogen oxide absorber includes incorporating the nitrogen oxide absorber with the oxidation catalyst. In one or more embodiments, configuring the nitrogen oxide absorber includes selecting the nitrogen oxide absorber to comprise a passive nitrogen oxide absorber. In one or more embodiments, configuring the nitrogen oxide absorber includes selecting the nitrogen oxide absorber to include or be a nitrogen oxide absorbing material that is a Pd-containing medium pore zeolite.

Examples

The present aftertreatment design, for example as illustrated in FIG. 2, once fully optimized, is expected to reduce the exhaust emissions to near-zero levels. The target in this study is to develop and optimize this system for the GCI engine to achieve EU7 targets in stage 1, and then further optimize this towards achieving near-zero level emissions. How this system works is described below, showing the operation of this system in two extreme RDE test cases.

In lower temperatures absorbing materials (PNA or HC/CO absrobers) will store the emissions until the other aftertreatment units (Catalysts and SCR) reach their operating temperatures. At higher temperatures, the additional SCR units being introduced in the underfloor position of the exhaust line where the exhaust temperature will be lower (below 400 C) so NOx conversion will still be possible.

Preliminary results from testing (and simulation) of the system as shown in FIG. 2, was obtained for Case 1 (cold start) and Case 2 (high load).

The aftertreatment capabilities (boundary conditions) for Case 1 include as follows. For PNA, NOx storage is effective at Temperature <200° C. For HC/CO absorbers, HC/CO storage is effective at Temperature <200° C. For OxC, HC/CO conversion at temperatures >180° C. For PNA, NOx storage capacity is 0.25 g/l to 0.5 g/l. For P(elec), 4 kW/2 kW=eHC: electrically heated catalyst. For urea dosing, dosing is effective at SCR temperature >180° C. For SCRF, NOx conversion occurs at temperature >220° C.

The aftertreatment capabilities (boundary conditions) for Case 2 include as follows. For PNA, NOx storage is effective at Temperature <200° C. For HC/CO absorbers, HC/CO storage is effective at Temperature <200° C. For OxC, HC/CO conversion at temperatures >180° C. For eHC, it is not required. For urea dosing, dosing is effective at SCR temperature >180° C. For SCRF, NOx conversion occurs at temperature <400° C.

Figure 3A:
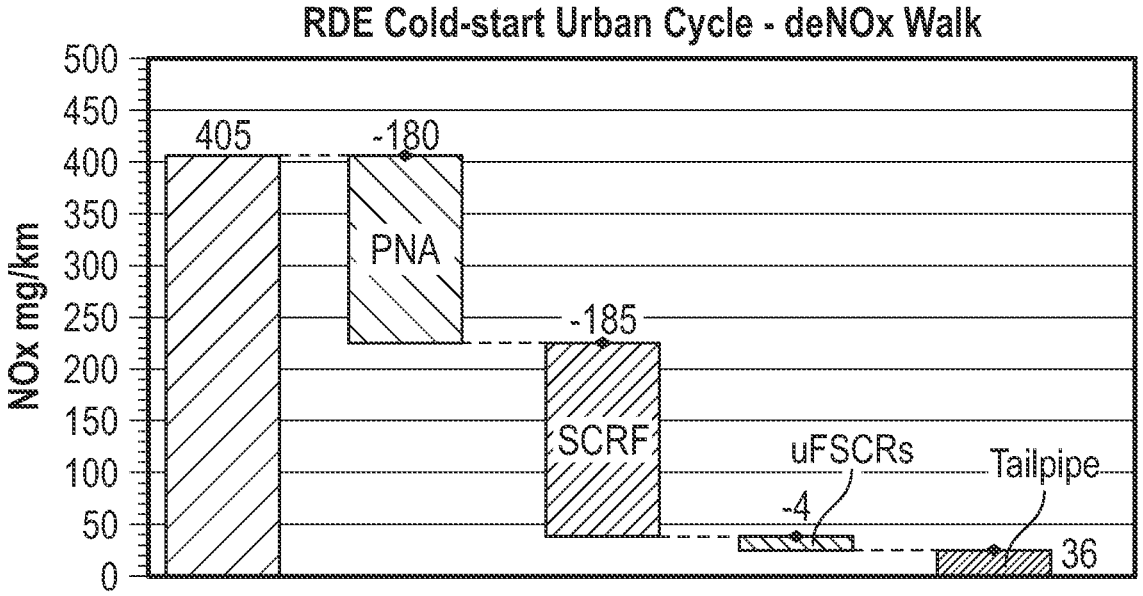
FIG. 3A is a graph of deNOx performance variation with stage of a "walk" through the system of FIG. 2 under cold start conditions, in accordance with to one or more embodiments.
Figure 3B:
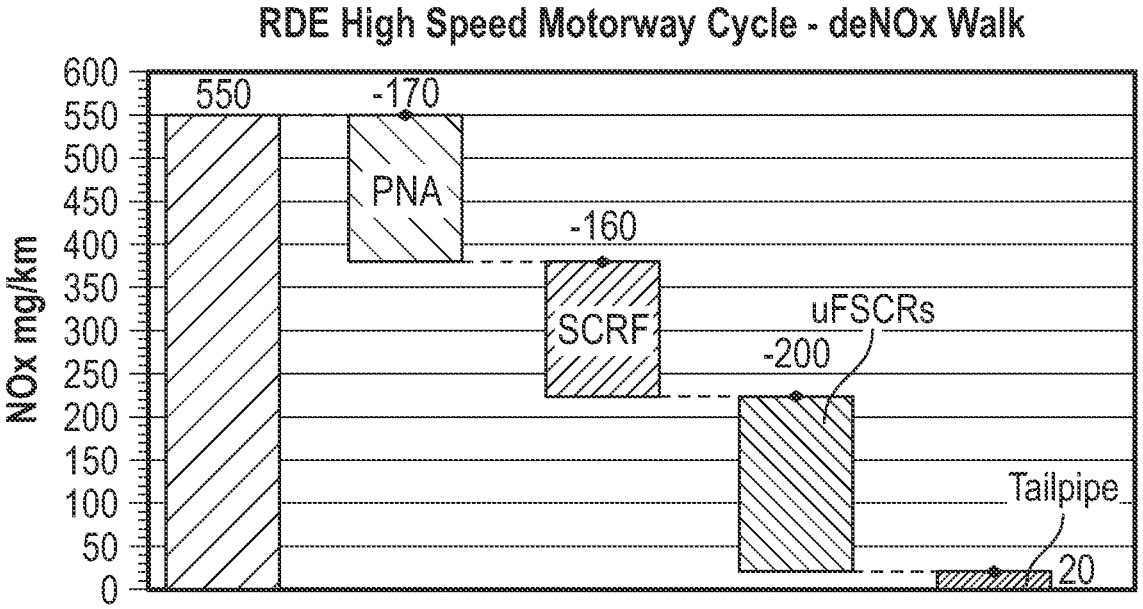
FIG. 3B is a graph of deNOx performance variation with stage of a "walk" through the system of FIG. 2 under high load conditions, in accordance with to one or more embodiments.

FIGS. 3A and 3B demonstrate some of the preliminary results from the testing (and simulation) of the system as shown in FIG. 2, for Case 1 (FIG. 3A) and Case 2 (FIG. 3B). FIG. 3A shows a deNOx walk for cold start conditions (Case 1). FIG. 3B shows a deNOx walk for high load conditions (Case 2).

FIGS. 3A and 3B show the deNOx breakdown for the slow urban and the high-speed motorway cycles (from cold start). Tailpipe NOx emissions are 36 mg/km and 20 mg/km respectively including cold start. This result was achieved by contributions from all aftertreatment components. The PNA and close-coupled SCR both contribute during the urban part achieving 90% NOx conversion. The underfloor SCR is required during motorway driving where it converts NOx which is not converted in the closed coupled SCR due to high temperature and high space-velocity. The underfloor SCR also allows higher $NH_3$ filling levels in the close-coupled SCR components by removing any transient excess ammonia and allowing full use of the close-coupled component deNOx capability.

Embodiments of the present disclosure may provide at least one of the following advantages. The present system and method reduce exhaust tailpipe emissions from ignition compression engine (ICE) vehicles to solve the environment pollution problem caused by combustion engines. The present system and method will be capable of meeting upcoming European real driving emissions standards, for example EU7 standards to be potentially introduced in about 2025 or 2026. Further, the present system and method have the potential to reduce some or all of criteria pollutants as specified by regulatory standards to near zero levels.

"Optionally" means that the subsequently described event or circumstances may or may not occur. The description includes instances where the event or circumstance occurs and instances where it does not occur.

"Includes" and its variations such as including mean includes but is not limited to, and its respective variations such as including but not limited to.

When the word "approximately" or "about" is used, this term may mean that there can be a variance in the value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it should be understood that another one or more embodiments are from the one particular value to the other particular value, along with all particular values and combinations thereof within the range.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for treatment of gasoline compression ignition engine exhaust, comprising:

a carbon monoxide absorber and a nitrogen oxide absorber, wherein nitrogen oxide comprises one or more compounds consisting of nitrogen and oxygen;

an oxidation catalyst downstream of the carbon monoxide absorber, wherein the nitrogen oxide absorber is disposed over the oxidation catalyst;

a close coupled reduction catalyst downstream of the nitrogen oxide absorber;

an electrically heated catalyst between the oxidation catalyst and the close coupled reduction catalyst;

an underfloor reduction catalyst downstream of the close coupled reduction catalyst; and an ammonia slip catalyst downstream of the underfloor reduction catalyst.

2. The system of claim 1, further comprising an ammonia sensor between the underfloor reduction catalyst and the ammonia slip catalyst, wherein the ammonia sensor is coupled to one or more reaction conditions of the ammonia slip catalyst.

3. The system of claim 1, wherein the carbon monoxide absorber comprises a passive carbon monoxide absorber.

4. The system of claim 1, wherein the carbon monoxide absorber comprises a material that absorbs carbon monoxide and one or more hydrocarbons.

5. The system of claim 1, wherein the carbon monoxide absorber comprises a carbon monoxide absorbing material comprises activated carbon.

6. The system of claim 1, wherein the nitrogen oxide absorber is incorporated with the oxidation catalyst.

7. The system of claim 1, wherein the nitrogen oxide absorber comprises a passive nitrogen oxide absorber.

8. The system of claim 1, wherein the nitrogen oxide absorber comprises a nitrogen oxide absorbing material comprising a Pd-containing medium pore zeolite.

9. A method of making a system for treating gasoline compression ignition engine exhaust, comprising:

aligning into the system a plurality of components comprising:

a carbon monoxide absorber and a nitrogen oxide absorber, wherein nitrogen oxide comprises one or more compounds consisting of nitrogen and oxygen;

an oxidation catalyst downstream of the carbon monoxide absorber, wherein the nitrogen oxide absorber is disposed over the oxidation catalyst;

a close coupled reduction catalyst downstream of the nitrogen oxide absorber;

an electrically heated catalyst between the oxidation catalyst and the close coupled reduction catalyst;

an underfloor reduction catalyst downstream of the close coupled reduction catalyst; and an ammonia slip catalyst downstream of the underfloor reduction catalyst;

configuring the carbon monoxide absorber to capture and store carbon monoxide under cold start operation;

configuring the nitrogen oxide absorber to capture and store nitrogen oxide, under cold start operation; and configuring the underfloor reduction catalyst and ammonia slip catalyst to in combination reduce slip ammonia released by the close coupled reduction catalyst under high load operation.

10. The method of claim 9, wherein configuring the underfloor reduction catalyst and ammonia slip catalyst comprises disposing an ammonia sensor therebetween; and coupling the ammonia sensor to one or more reaction conditions of the ammonia slip catalyst.

11. The method of claim 9, wherein configuring the carbon monoxide absorber comprises selecting the carbon monoxide absorber to comprise a passive carbon monoxide absorber.

12. The method of claim 9, wherein configuring the carbon monoxide absorber comprises selecting the carbon monoxide absorber to comprise a material that absorbs carbon monoxide and one or more hydrocarbons.

13. The method of claim 9, wherein configuring the carbon monoxide absorber comprises selecting the carbon monoxide absorber to comprise a carbon monoxide absorbing material comprises activated carbon.

14. The method of claim 9, wherein configuring the nitrogen oxide absorber comprises incorporating the nitrogen oxide absorber with the oxidation catalyst.

15. The method of claim 9, wherein configuring the nitrogen oxide absorber comprises selecting the nitrogen oxide absorber to comprise a passive nitrogen oxide absorber.

16. The method of claim 9, wherein configuring the nitrogen oxide absorber comprises selecting the nitrogen oxide absorber to comprise a nitrogen oxide absorbing material comprising a Pd-containing medium pore zeolite.

* * * * *